US005989495A

United States Patent [19]

Isayama et al.

[11] Patent Number: 5,989,495

[45] Date of Patent: Nov. 23, 1999

[54] ALUMINUM ALLOY FOR USE IN CASTINGS

[75] Inventors: Tomoaki Isayama, Fukuoka pref.; Osamu Shibata, Chiba pref., both of Japan

[73] Assignees: Kyushu Mitsui Aluminum Industries, Inc., Fukuoka pref.; Nippon Precision Casting Corp., Chiba pref., both of Japan

[21] Appl. No.: 08/692,805

[22] Filed: Jul. 30, 1996

[51] Int. Cl.[6] ..... C22C 21/08

[52] U.S. Cl. ..... 420/535; 420/533; 148/417; 148/439

[58] Field of Search ..... 148/417, 439; 420/535, 533

[56] References Cited

U.S. PATENT DOCUMENTS

| | | | |
|---|---|---|---|
| 3,925,067 | 12/1975 | Sperry et al. | 420/535 |
| 4,867,805 | 9/1989 | Agrawal et al. | 148/437 |
| 5,211,910 | 5/1993 | Pichens et al. | 148/439 |
| 5,593,516 | 1/1997 | Cassada | 148/417 |

FOREIGN PATENT DOCUMENTS

| | | |
|---|---|---|
| 62-83445 | 4/1987 | Japan . |

OTHER PUBLICATIONS

CA 113:63797, Aug. 1985.

*Primary Examiner*—Sikyin Ip
*Attorney, Agent, or Firm*—Jordan and Hamburg LLP

[57] ABSTRACT

An aluminum alloy for use in castings, comprising 0.0005–0.01 weight % of Fe, 0.0005–0.01 weight % of Si, 2.5–6.5 weight % of Cu, 0.10–0.50 weight % of Mg, 0.001–0.40 weight % of Mn, 0.10–0.50 weight % of Ti, 0.20–1.2 weight % of Ag, 0.002–0.01 weight % of B, no more than 0.01 weight % of any other individual component aside from Al, and the balance Al. The aluminum alloy is thereby designed to provide improved toughness without detracting from tensile strength, proof stress, and hardness.

1 Claim, No Drawings

ALUMINUM ALLOY FOR USE IN CASTINGS

BACKGROUND OF THE INVENTION

1. Field of the Invention

This invention relates to an aluminum alloy for use in castings.

2. Description of the Prior Art

In recent years, aluminum forgings have been in widespread use in aircraft materials and industrial rotors. However, these forgings have problems such as difficulties in forging as well as high costs when complicatedly configured articles or large-sized components are required for formation.

As a way of overcoming such problems, castings using an Al—Cu—Mg—Ag series aluminum alloy have come into service.

Although exhibiting higher strength, the aforesaid aluminum alloy castings have a drawback of lower toughness (elongation) when compared with the forgings. As matters stand, such castings are restricted for use in members that require reliability.

SUMMARY OF THE INVENTION

An object of the present invention is to provide an aluminum alloy for use in castings, which affords improved toughness without diminishing tensile strength and proof stress.

In order to achieve this object, the present invention provides an aluminum alloy for use in castings, comprising 0.0005–0.01 weight % of Fe, 0.0005–0.01 weight % of Si, 2.5–6.5 weight % of Cu, 0.10–0.50 weight % of Mg, 0.001–0.40 weight % of Mn, 0.10–0.50 weight % of Ti, 0.20–1.2 weight % of Ag, 0.002–0.01 weight % of B, no more than 0.01 weight % of any other individual component aside from Al, and the balance Al.

Next, the reason for such limitation on each compositional constituent of the above-mentioned alloy will be described.

The Fe content is set to be 0.01 or smaller weight % because otherwise Fe forms Al—Fe—Si and Al—Cu—Fe compounds during cast solidification, thereby resulting in reduced toughness. However, no further improvement due to the reduction of Fe content is observed when the Fe content is less than 0.0005% by weight. Thus, the Fe content is determined to be 0.0005 to 0.01% by weight.

Similar to Fe, the Si content is set to be 0.01 or smaller weight % as well because otherwise Si forms the Al—Fe—Si compound during solidification, thereby resulting in reduced toughness. However, no further improvement due to reduction of Si content is observed when the Si content is less than 0.0005% by weight. Thus, the Si content is determined to be 0.0005 to 0.01% by weight.

The Cu content of 2.5 or greater weight % is required for precipitation hardening of omega phase-$CuAl_2$. However, the Cu content exceeding 6.5 weight % causes coarse $CuAl_2$ to be susceptible to crystallization at grain boundaries during solidification. This results in reduced mechanical properties. Thus, the Cu content is determined to be 2.5 to 6.5% by weight.

Because Mg and Ag form a $Mg_3Ag$ compound and accelerate the precipitation of omega phase-$CuAl_2$, the Mg and Ag contents are determined to range from 0.10 to 0.50 weight % and from 0.20 to 1.2 weight %, respectively.

Mn is added in an amount of 0.001 or greater weight % in order to change a precipitation form of Fe from the needle-shaped, Al—Fe—Si compound to a plate-shaped, Al—Fe—Si—Mn compound to prevent the occurrence of reduced toughness. However, a Mn content greater than 0.4 weight % produces coarse crystallized substances, with a concomitant reduction in mechanical strength. Thus, the Mn content is determined to be 0.001 to 0.4% by weight.

Ti is added in an amount of 0.10 or greater weight % in order to provide both a fine casting structure and improved mechanical properties. However, a Ti content greater than 0.50 weight % produces a coarse Ti compound, with a consequential reduction in toughness. Hence, the Ti content is determined to be 0.10 to 0.50% by weight.

B is added in an amount of 0.002 or greater weight % in order to provide both a fine casting structure and improved castability in conjunction with Ti. However, no improvement due to the presence of B is observed when the B content is greater than 0.01% by weight. Hence, an optimal B content is 0.002 to 0.01% by weight.

DESCRIPTION OF THE PREFERRED EMBODIMENT

A form of embodying the invention will now be described with reference to an embodiment thereof and comparison examples.

Different types of aluminum alloys, as illustrated in Table 1, were melted and then air-cast to ambient in both metallic molds and precision casting molds. These molds were all retained at different temperatures. After heat treatment, the above-mentioned alloys were subjected to (1) tensile test and (2) hardness measurement. Test conditions are shown below:

(1) Tensile Test apparatus: Instron type tensile testing machine test piece: JIS No. 4 test piece (2) Hardness Test apparatus: Brinell hardness tester

EXAMPLE I

Table 2 shows results of the tensile test and hardness measurement on the test pieces that were cast in the individual precision casting molds. The molds were maintained at different temperatures.

The alloy according to the present invention exhibited tensile strength, proof stress, and hardness, which were all comparable at any mold temperature to those of the comparison material. Furthermore, the aforesaid alloy was observed to achieve an improvement in elongation by 45–57 percent.

EXAMPLE II

Similarly, Table 2 shows results of the tensile test and hardness measurement on the test pieces that were cast in and discharged out of the individual metallic molds. The molds were held at different temperatures.

With a composition similar to that shown in Table 1, the alloy according to the present invention exhibited tensile strength, proof stress, and hardness, which were all comparable at any mold temperature to those of the comparison material. Furthermore, the aforesaid alloy was observed to realize an improvement in elongation by 68–500 percents. As evidenced by Examples I and II, the alloy according to the present invention exhibits performance equivalent to or greater than that of the comparison material at any solidification rate, and the reason therefor may be sought in limitation of the contents of the Fe and Si components to 0.0005–0.01% by weight.

As described hereinabove, according to the present invention, the alloy containing the limited Fe and Si contents and adequate amounts of Cu, Mg, Ag, Mn, Ti, and B added for balance is cast and heat-treated by various casting methods (any casting process such as sand mold casting, metal mold casting, lost wax process, and shell molding process). The foregoing alloy thereby exhibits tensile strength, proof stress, and hardness which are all comparable to the comparison alloy, and further provides improved elongation over the comparison alloy. Thus, the present invention provides an optimal alloy for an article of manufacture requiring toughness.

TABLE 1

| | (weight %) | | | | | | | |
|---|---|---|---|---|---|---|---|---|
| | Cu | Si | Mg | Fe | Mn | Ti | Ag | B |
| Alloy According to the Present Invention | 4.6 | 0.01 or smaller | 0.23 | 0.01 or smaller | 0.33 | 0.25 | 0.60 | 0.005 |
| Comparison Alloy "A" | 4.5 | 0.04 | 0.24 | 0.05 | 0.32 | 0.26 | 0.59 | 0.005 |

TABLE 2

| Alloy | Mold | | Tensile Strength | | Proof Stress | | Elongation | Brinell hardness |
|---|---|---|---|---|---|---|---|---|
| | | | kgf/mm$^2$ | N/mm$^2$ | kgf/mm$^2$ | N/mm$^2$ | % | HB |
| Alloy According to the Present Invention | Metal Mold | Ordinary Temperature | 46.7 | 460 | 41.6 | 410 | 13.8 | 125 |
| | | 300° C., Facing | 39.5 | 390 | 39.1 | 385 | 2.4 | 117 |
| | Precision Casting Mold | 700° C. | 44.2 | 435 | 38.8 | 380 | 6.0 | 126 |
| | | 500° C. | 45.9 | 450 | 40.7 | 400 | 7.0 | 125 |
| Comparison Material "A" | Metal Mold | Ordinary Temperature | 46.2 | 455 | 39.4 | 385 | 8.2 | 124 |
| | | 300° C., Facing | 40.1 | 395 | 39.2 | 385 | 0.4 | 116 |
| | Precision Casting Mold | 700° C. | 43.2 | 425 | 39.7 | 390 | 3.8 | 120 |
| | | 500° C. | 44.7 | 440 | 39.7 | 390 | 4.8 | 119 |

Heat Treatment: T7 treatment

What is claimed is:

1. An aluminum alloy for use in castings, consisting of 0.0005–0.01 weight % of Fe, 0.0005–0.01 weight % of Si, 2.5–6.5 weight % of Cu, 0.10–0.50 weight % of Mg, 0.001–0.40 weight % of Mn, 0.10–0.50 weight % of Ti, 0.20–1.2 weight % of Ag, 0.002–0.01 weight % of B, no more than 0.01 weight % of any other individual component aside from Al, and the balance Al.

* * * * *